US008869494B2

(12) United States Patent
Mader

(10) Patent No.: US 8,869,494 B2
(45) Date of Patent: Oct. 28, 2014

(54) JOINT BETWEEN THE ENDS OF PREFABRICATED SPACERS FOR INSULATING GLASS, AND PROCESS FOR PRODUCING SAID JOINT

(75) Inventor: Leopold Mader, Neuhofen/Ybbs (AT)

(73) Assignee: LISEC Austria GmbH, Seitenstetten (AT)

( * ) Notice: Subject to any disclaimer, the term of this patent is extended or adjusted under 35 U.S.C. 154(b) by 250 days.

(21) Appl. No.: 13/509,368

(22) PCT Filed: Aug. 2, 2011

(86) PCT No.: PCT/AT2011/000323

§ 371 (c)(1),
(2), (4) Date: May 11, 2012

(87) PCT Pub. No.: WO2012/037586

PCT Pub. Date: Mar. 29, 2012

(65) Prior Publication Data

US 2012/0230759 A1 Sep. 13, 2012

(30) Foreign Application Priority Data

Sep. 23, 2010 (AT) ..... A 1586/2010

(51) Int. Cl.

| | |
|---|---|
| ***E06B 7/16*** | (2006.01) |
| ***E06B 3/667*** | (2006.01) |
| ***E06B 3/673*** | (2006.01) |
| *E06B 3/663* | (2006.01) |
| *E06B 3/67* | (2006.01) |

(52) U.S. Cl.

CPC ..... *E06B 3/667* (2013.01); *E06B 3/66304* (2013.01); *E06B 3/6715* (2013.01); *E06B 3/66328* (2013.01); *E06B 3/67308* (2013.01); *E06B 3/67321* (2013.01)

USPC ..... 52/788.1; 52/787.11; 52/204.597; 52/656.7; 52/204.591

(58) Field of Classification Search

CPC . E06B 3/6612; E06B 3/66304; E06B 3/6715; E06B 7/16; E04B 1/625; E04B 1/74; E04B 1/76

USPC ..... 52/656.2, 656.7, 656.5, 656.1, 788.1, 52/657, 658, 204.71, 204.597, 204.591, 52/800.11, 787.11, 745.15, 745.16

See application file for complete search history.

(56) References Cited

U.S. PATENT DOCUMENTS

| | | | | |
|---|---|---|---|---|
| 1,669,667 | A * | 5/1928 | Levine | 52/631 |
| 2,347,480 | A * | 4/1944 | Holtzman | 52/657 |

(Continued)

FOREIGN PATENT DOCUMENTS

| | | |
|---|---|---|
| DE | 30 02 904 | 8/1980 |
| DE | 37 26 274 | 3/1988 |

(Continued)

OTHER PUBLICATIONS

International search report dated Nov. 2, 2011 in corresponding PCT/AT2011/000323.

*Primary Examiner* — Phi A

(74) *Attorney, Agent, or Firm* — Young & Thompson

(57) ABSTRACT

A diffusion-tight joint (30) between ends of prefabricated spacers (10) that support a diffusion barrier (3) on the spacer outer face is achieved in that a tongue (9) is formed from the diffusion barrier (3) at an end of two spacers (10) that abut each other at a joint (30), the tongue protruding over the end. The tongue (9) is fixed to the outer face of the diffusion barrier (3) of the other end of the spacer (10) using an adhesive application (13) so that an overlapping of the diffusion barriers (3) of both ends is achieved. The formation of the joint can be formed in the corner region of prefabricated spacer frames (10) or in straight regions of spacers (10), thus wherever ends of spacers (10) that are prefabricated abut each other.

9 Claims, 2 Drawing Sheets

(56) References Cited

U.S. PATENT DOCUMENTS

| | | | | | |
|---|---|---|---|---|---|
| 2,565,937 | A | | 8/1951 | Verhagen | |
| 3,327,766 | A | * | 6/1967 | Kurz | 160/381 |
| 4,084,720 | A | * | 4/1978 | Thurston | 220/690 |
| 4,269,255 | A | * | 5/1981 | Nailor et al. | 160/381 |
| 4,387,128 | A | * | 6/1983 | Emms et al. | 428/60 |
| 4,453,855 | A | * | 6/1984 | Richter et al. | 403/295 |
| 4,489,512 | A | * | 12/1984 | Schovee | 40/700 |
| 4,667,450 | A | * | 5/1987 | Stefnik et al. | 52/238.1 |
| 4,769,105 | A | | 9/1988 | Lisec | |
| 4,841,696 | A | * | 6/1989 | Miller | 52/202 |
| 4,905,334 | A | * | 3/1990 | Oppenhuizen | 52/511 |
| 4,924,649 | A | * | 5/1990 | Taylor | 52/656.9 |
| 5,007,217 | A | | 4/1991 | Glover et al. | |
| 5,161,346 | A | * | 11/1992 | Olson et al. | 52/746.1 |
| 5,675,944 | A | * | 10/1997 | Kerr et al. | 52/172 |
| 5,678,367 | A | * | 10/1997 | Kline | 52/211 |
| 5,855,972 | A | | 1/1999 | Kaeding | |
| 5,910,083 | A | * | 6/1999 | Richardson et al. | 52/171.1 |
| 5,927,039 | A | * | 7/1999 | De Boer | 52/656.9 |
| 6,023,898 | A | * | 2/2000 | Josey | 52/309.5 |
| 6,052,957 | A | * | 4/2000 | Minnich | 52/202 |
| 7,043,886 | B1 | * | 5/2006 | Chubb | 52/656.4 |
| 2002/0166305 | A1 | * | 11/2002 | Weller | 52/658 |
| 2009/0013624 | A1 | * | 1/2009 | Sibbett | 52/204.62 |

FOREIGN PATENT DOCUMENTS

| | | |
|---|---|---|
| DE | 102 12 359 | 10/2003 |
| DE | 103 50 312 | 6/2005 |
| EP | 0 152 807 | 8/1985 |
| GB | 2041434 | 9/1980 |

* cited by examiner

JOINT BETWEEN THE ENDS OF PREFABRICATED SPACERS FOR INSULATING GLASS, AND PROCESS FOR PRODUCING SAID JOINT

BACKGROUND OF THE INVENTION

1. Field of the Invention

The invention refers to a joint in spacers for insulating glass with a diffusion barrier.

2. Description of the Related Art

In order to connect the plates of dual-pane or multi-pane insulating glass with space between them, spacers are provided between the glass plates.

Such spacers can be frames consisting of metal profiles (aluminum or steel profiles) that are closed to form a frame by bending or by means of corner joints consisting of several sections.

There are also prefabricated spacers that essentially have a strand of thermoplastic or elastoplastic material, which is attached between glass plates to join them together with spaces between them in order to form an insulating glass pane. Such prefabricated spacers are known from DE 30 02 904 A, EP 0 152 807 B, U.S. Pat. No. 4,561,929 A, DE 37 26 274 C, DE 102 12 359 A, and DE 103 50 312 B.

From the above-mentioned documents, it is also known that, on their surfaces that face outward in the operating position, i.e., those facing toward the edge joint between the glass plates of the insulating glass pane, prefabricated spacers have a diffusion barrier that is, for example, a metal strip. This metal strip can be corrugated and is made of steel, for example.

Furthermore, it is known practice to incorporate into the bodies of the spacers, i.e., into the plastic strands of prefabricated spacers, a desiccant, e.g., a molecular sieve, that serves to keep the space between the insulating glass panes dry by binding any water that may be contained therein.

Forming a diffusion-tight joint between the ends of a prefabricated spacer or between the ends of sections of prefabricated spacers is problematic in prefabricated spacers.

BRIEF SUMMARY OF THE INVENTION

The object of the invention is to make available an improved joint between the ends of prefabricated spacers.

This object is achieved according to the invention with the features of Claim 1.

Preferred and advantageous embodiments of the invention are the subjects of the subclaims.

Since, in the invention, the joint between the abutting ends of prefabricated spacers is bridged by a diffusion barrier, with the diffusion barrier of one end of the spacers being formed as one piece, an absolutely diffusion-tight joint is ensured.

In one embodiment of the invention, it can be provided that the protruding end of the diffusion barrier, e.g., of the metal (steel) strip, is secured by means of adhesive to the outside of the diffusion barrier of the abutting end of the spacer. This adhesive can, for example, be an adhesive that is used in the insulating glass industry, in particular one based on butyl rubber.

The joint formation according to the invention can be provided in the area of corners of an insulating glass pane where two ends of the prefabricated spacer abut each other at a 90° angle, for example, or else in a straight section of the spacer.

If the ends of the spacer abut each other in a straight section of the circumference of the insulating glass pane, the facing end surfaces (the faces) of the prefabricated spacers can be oriented normally to the longitudinal extension of the spacers or at an acute angle (preferred).

The invention also pertains to a process for the production of a butt joint according to the invention between adjacent, abutting ends of spacers, which process is characterized by the features of the independent process claim.

Preferred and advantageous implementations of the process of the invention are the subjects of the subclaims that are dependent on the process claim.

The invention can be used on all kinds of spacers made of plastic (thermoplastic material, e.g., butyl rubber or elastoplastic material, based on, e.g., polyurethane) that on the one side (the outside in the insulating glass) have a diffusion barrier, e.g. a barrier consisting of a sheet of metal or plastic.

BRIEF DESCRIPTION OF THE DRAWINGS

Further details and features of the invention are set forth in the following specification of preferred embodiments with the aid of the partially schematic drawings.

Here.

DETAILED DESCRIPTION OF THE PREFERRED ENBODIMENTS

Figure 1:
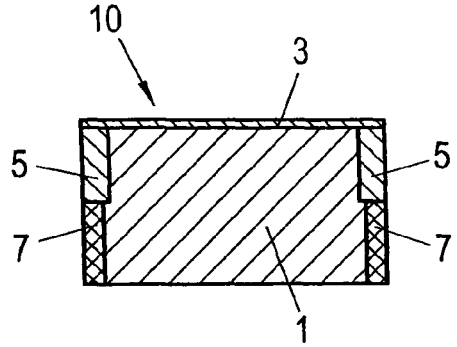
FIG. 1 shows schematically and in cross-section an example of a prefabricated spacer for insulating glass.

A spacer 10 in which the invention can be used is depicted schematically and by way of example in FIG. 1. The spacer 10 has a core 1 made of plastic; here, thermoplastic materials such as plastics based on polyurethane and silicone can also be considered. One of the large surfaces of the spacer 10, specifically one of the surfaces that in the insulating glass are oriented transversely to the surface extension of the insulating glass, is covered by a diffusion barrier 3, where the diffusion barrier 3 is a corrugated metal strip, for example, preferably a corrugated steel strip, which is provided on the outside surface of the spacer 10 in the insulating glass.

On both sides, in the area adjacent to the diffusion barrier 3, the lateral surfaces of the spacer 10 have strands 5 of adhesive, in particular a butyl rubber-based adhesive that ensures a diffusion seal, and adjacent thereto (in the working position within the strands 5 of adhesive) additional strands 7 of adhesive to ensure secure attachment of the spacer 10 to the inner surfaces of glass plates 20 of insulating glass.

In order to produce a joint 30 according to the invention in the area of a corner 40 of an insulating glass pane (FIG. 8), the procedure is in particular as described below and as indicated by FIGS. 2 to 7.

Figure 2:
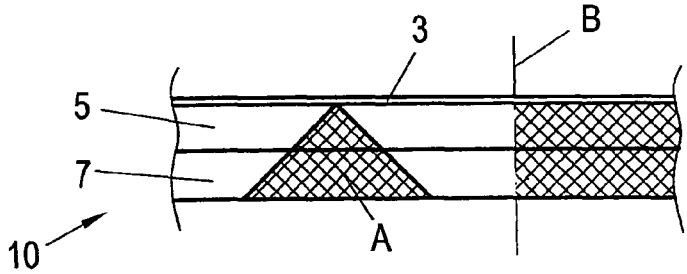
FIGS. 2 to 5 show the preparation of an end of a spacer for the production of a butt joint according to the invention.

First, as indicated in FIG. 2, a V-shaped area A of the spacer 10, indicated by cross-hatching, is removed from its core 1. Then, the spacer 10 is cut off in the area indicated by the dashed separation line B in FIG. 2.

Figure 3:
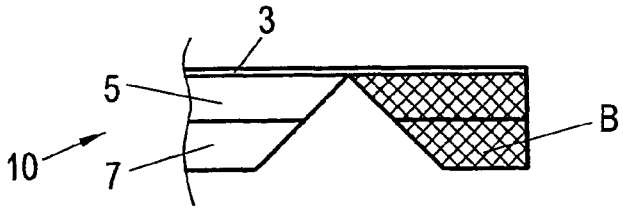
Figure 4:
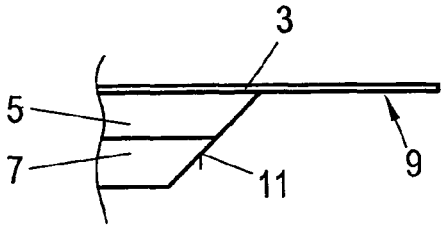
Figure 9:
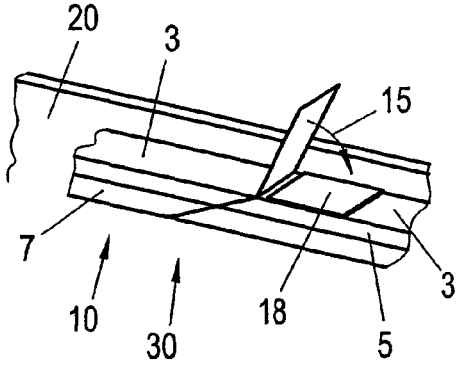
FIG. 9 shows an embodiment in which the butt joint according to the invention is provided in a straight section of a spacer for insulating glass.

From the end of the spacer 10 that is prepared in this way, as depicted in FIG. 3, an area designated B in FIG. 3 is removed, so that, as shown in FIG. 4, a tongue 9 from diffusion barrier 3 remains that protrudes over the end of the spacer 10 with a face 11 that is at an angle of, for example, 45° to its lengthwise extension. The spacer 10, with the end prepared in this way, is applied to a glass plate 20, whereby the end comes to rest in the area of a corner 40 (FIGS. 6, 7) or in a straight area (FIG. 9). Now, the second end of a spacer 10, which end is to be connected in the joint 30, and which likewise has a face that runs obliquely to its lengthwise extension, is put into place (i.e., applied to the glass plate 20), so that a corner formation, which in the embodiment shown amounts to 90°, is obtained. It should be noted that sections of the prefabricated spacer 10 that abut one another in a corner 40 can comprise any angle other than 90°.

Figure 5:
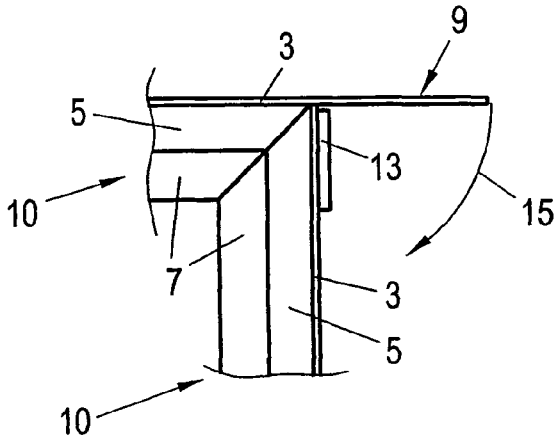
Figure 6:
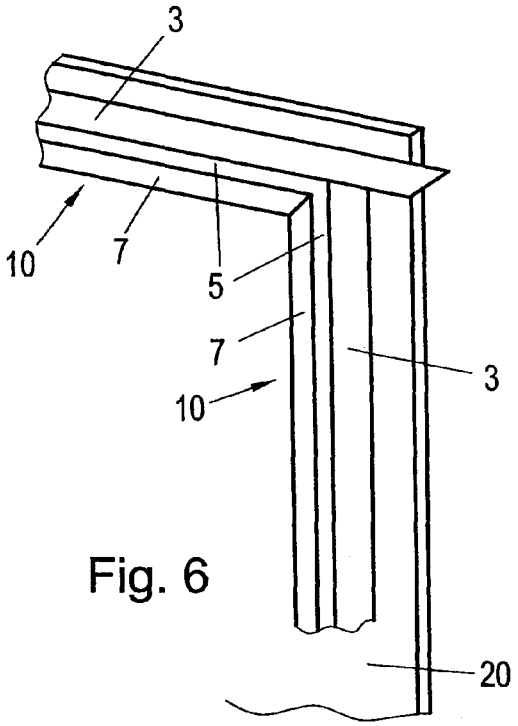
FIGS. 6 and 7 show additional steps in the production of a butt joint according to the invention in a corner area.
Figure 7:
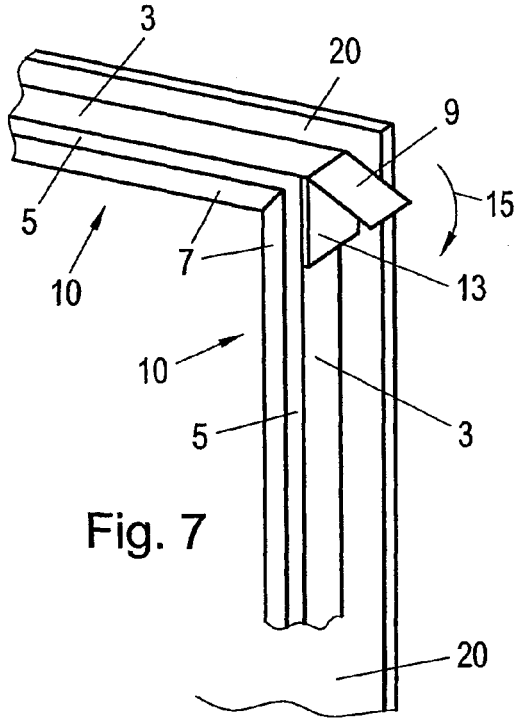

A layer 13 of adhesive is attached to the exterior surface of the diffusion barrier 3 of the other end of the spacer. It is, for example, a butyl rubber-based adhesive. On the latter, as indicated in FIGS. 5 and 7, the protruding tongue 9 (strip) of the diffusion barrier 3 is lapped around in the direction of the arrow 15 in FIG. 5 and FIG. 7 and is made permanent by the adhesive layer 13 on the outside of the diffusion barrier 3 of the other end of the spacer 10.

It is clear that such an uninterrupted diffusion barrier 3 is obtained since the ends of the diffusion barrier 3 of the two ends of the spacers 10 overlap each other and are tightly connected together by the layer 13 of adhesive.

Figure 8:
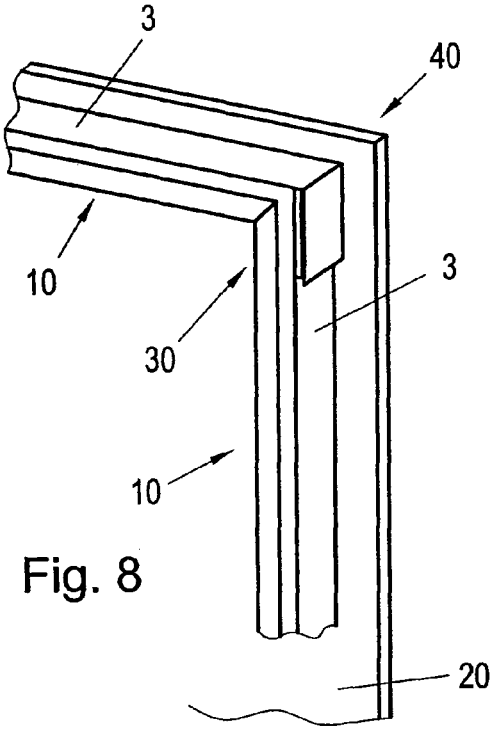
FIG. 8 shows a butt joint according to the invention in a corner area.

The result, i.e., a joint 30 according to the invention in the corner area of an insulating glass pane, is depicted in FIG. 8.

The joint 30 according to the invention can also be executed in a straight area of a spacer 10, as indicated schematically in FIG. 9. Here, as well, the spacer 10 is prepared at one end in the way shown in FIGS. 2 to 4.

On the outside of the diffusion barrier 3 of the other end of the spacer 10, a coating 13 of adhesive is applied, and then the tongue 9 is lapped over in the direction of the arrow 15 in FIG. 9, so that a diffusion barrier that runs without interruption is formed (overlapping ends of diffusion barriers 3 of both ends of the spacers 10).

The faces 11 of the abutting ends of the spacers 10 can, as shown in FIG. 9, be oriented at an acute angle to the lengthwise extension. It is also possible, however, to form a joint 30 in which the faces 11 of the spacers 10 are formed at a right angle to the lengthwise extension.

In summary, an embodiment of the invention can be described as follows.

A diffusion-tight joint 30 between ends of prefabricated spacers 10, which on their outside have a diffusion barrier 3, is obtained by virtue of the fact that, on one end of two adjoining spacers 10 that abut one another at a joint 30, a tongue 9 that protrudes over the end from diffusion barrier 3 is formed. This tongue 9 is made permanent with the aid of an adhesive layer 13 on the outside of the diffusion barrier 3 of the other end of the spacer 10, so that an overlapping of the two ends of the diffusion barriers 3 is obtained. The joint 30 can be formed in the area of corners 40 of prefabricated spacer frames 10 or in straight sections of spacers 10, i.e., always where ends of spacers 10 that are prefabricated abut one another.

The invention claimed is:

1. A system, comprising:

a joint; and a plurality of prefabricated spacers for a plurality of insulating glass plates, the joint being disposed between ends of abutting ones of the prefabricated spacers, the spacers having a diffusion barrier that is a metal strip on an outer side facing toward the joint disposed between the glass plates, a protruding tongue being integral with and protruding from the diffusion barrier on one end of a first one of the abutting spacers the protruding tongue being bonded to an outside of the diffusion barrier at one end of another one of the abutting spacers.

2. The system according to claim 1, wherein the bonding is formed with an adhesive based on butyl rubber.

3. The system according to claim 1, wherein the joint is disposed in a corner between abutting spacers, the tongue lapping over by being bent onto the diffusion barrier at the end of the other spacer that abuts the first spacer in the corner.

4. The system according to claim 1, wherein the joint is disposed in the vicinity of a straight section of the abutting spacers, the faces of the abutting spacers being oriented at a 90° angle to a lengthwise extension of the abutting spacers.

5. The system according to claim 1, wherein the joint is formed in the vicinity of a straight section of the abutting spacers, the faces of the abutting spacers being oriented at an acute angle to a lengthwise extension of the abutting spacers.

6. A method, comprising:

producing the joint between the ends of the spacers according to claim 1, producing the joint between the ends of the spacers including removing, on the one end of the first spacer, a plastic core of the first spacer and coatings provided on the sides of the plastic core and leaving a part of the diffusion barrier, of the first spacer, that protrudes as a tongue, and attaching the tongue of the diffusion barrier of the first spacer to the outside of the diffusion barrier of an adjacent end of the other abutting spacer.

7. The method according to claim 6, wherein the protruding tongue of the diffusion barrier of the first spacer is attached to the outside of the diffusion barrier of the adjacent end of the other spacer with an adhesive.

8. The method according to claim 6, further comprising:

putting the protruding tongue of the diffusion barrier of the first spacer in place by bending the protruding tongue at the diffusion barrier of the end of the other spacer that is at an angle to the end of the first spacer, when the joint is formed in a corner between the abutting spacers.

9. The method according to claim 7, further comprising:

putting the protruding tongue of the diffusion barrier of the first spacer in place by bending the protruding tongue at the diffusion barrier of the end of the other spacer that is at an angle to the end of the first spacer, when the joint is formed in a corner between the abutting spacers.

* * * * *